US005322028A

United States Patent [19]

Hashiride et al.

[11] Patent Number: 5,322,028

[45] Date of Patent: Jun. 21, 1994

[54] APPARATUS FOR DETECTING AMOUNT OF LEFTOVER LOWER THREAD IN A SEWING MACHINE

[75] Inventors: Tadaaki Hashiride, Okazaki; Yutaka Katou, Kariya, both of Japan

[73] Assignee: Aisin Seiki Kabushiki Kaisha, Kariya, Japan

[21] Appl. No.: 73,044

[22] Filed: Jun. 8, 1993

[30] Foreign Application Priority Data

Jun. 8, 1992 [JP] Japan ..... 4-147560

[51] Int. Cl.[5] ..... D05B 69/36

[52] U.S. Cl. ..... 112/278

[58] Field of Search ..... 112/278, 273, 121.11, 112/163, 103, 121.12; 242/37 R

[56] References Cited

U.S. PATENT DOCUMENTS 4,192,243 3/1980 Blessing ..... 112/273
4,196,685 4/1980 Tamura ..... 112/278 X
4,691,648 9/1987 Hirose ..... 112/278 X
4,991,528 2/1991 Bellio ..... 112/278
5,161,475 11/1992 Tawara et al. ..... 112/278

FOREIGN PATENT DOCUMENTS 226455 7/1990 Japan .

*Primary Examiner*—Peter Nerbun
*Attorney, Agent, or Firm*—Sughrue, Mion, Zinn, Macpeak & Seas

[57] ABSTRACT

A sewing machine is disclosed in which an expenditure of lower thread is calculated from an expenditure of an upper thread. The expenditure of the upper thread is determined from the amount of rotation of a rotary tension disc. A pair of Hall elements deliver two phase signals, a phase difference therebetween is utilized to determine the direction of rotation, thus removing the likelihood of an error being caused by a rotation in the reverse direction. When the amount of leftover lower thread reduces below a given value, an alarm is issued. Where a plurality of needles are used, an expenditure of an upper thread is obtained for each tension disc, and the total expenditure is obtained.

2 Claims, 7 Drawing Sheets

APPARATUS FOR DETECTING AMOUNT OF LEFTOVER LOWER THREAD IN A SEWING MACHINE

BACKGROUND OF THE INVENTION

The invention relates to an apparatus for detecting amount of leftover lower thread which may be utilized in an industrial sewing machine, for example.

A prior art for an apparatus for detecting amount of leftover lower thread of the kind described is disclosed in Japanese Utility Model Publication No. 26,455/1990, for example.

In the prior art practice, an apparatus for detecting amount of leftover lower thread in a sewing machine comprises an optical detector located adjacent to a bobbin on which a lower thread is disposed as a winding for detecting the level of transmitting or reflected light which varies with the amount of winding of lower thread on the bobbin or the leftover amount thereof, thus directly deriving the amount of leftover lower thread.

However, the use of an optical detector of this kind requires a bobbin or a shuttle race which is machined to a special configuration, and a customary bobbin or shuttle race cannot be used with such detector. An optical detector is susceptible to a malfunctioning caused by a contamination thereof caused by fragments of thread or by oil which is unavoidable in an industrial sewing machine. Since an industrial sewing machine is designed for continuous operation over a prolonged period of time under nearly unmanned condition, the detector may fail to detect the exhaustion of the lower thread as a result of a malfunctioning thereof to allow a continued operation of the machine. Then there results a number of unsewn fabrics, requiring a repeated sewing operation and thus degrading the production efficiency.

SUMMARY OF THE INVENTION

Accordingly, it is an object of the invention to provide an apparatus for detecting amount of leftover lower thread which avoids the need for a bobbin or shuttle race that is specially machined and which assures a high reliability.

The object is accomplished according to a first feature of the invention by providing an apparatus for detecting amount of leftover lower thread in a sewing machine comprising input means (50) for entering information indicative of the length of a winding on a lower thread bobbin, means (20, 21, 22) for generating a rotation signal which corresponds to the amount of rotation of a rotary tension regulator disposed on a path for an upper thread, annunciator means (68) for producing a leftover amount signal at least when the amount of leftover lower thread reduces below a given value, and means (40) for calculating the amount of leftover lower thread based on the length of winding on the lower thread bobbin which is supplied from the input means and a signal delivered by the rotation signal generating means and for energizing the annunciator means in accordance with a result of calculation.

According to a second feature of the invention, the means for generating a rotation signal includes a plurality of signal generator means which deliver signals having mutually different phases, and the means for calculating the leftover amount discriminate the direction of rotation of the rotary tension regulator in accordance with a phase difference or differences between the plurality of signals produced by the rotation signal generator means, and determine an expended length of the upper thread based on the amount of rotation occurring in the direction of forward rotation and the amount of rotation occurring in the reverse direction.

According to a third feature of the invention, there is provided an apparatus for detecting amount of leftover lower thread in a sewing machine which includes a plurality of rotary tension regulators through which each of a plurality of upper threads passes. The apparatus comprises input means for entering information indicative of a length of winding on a lower thread bobbin, a plurality of rotation signal generator means for delivering signals, each corresponding to the amount of rotation of the respective rotary tension regulator, annunciator means for delivering a leftover amount signal at least when the amount of leftover lower thread reduces below a given value, and means for calculating an expended length of each upper thread based on signals delivered from the plurality of rotation signal generator means, for calculating the amount of leftover lower thread based on a total expended length of the upper threads and the length of winding on the lower thread bobbin which is supplied from the input means, and for energizing the annunciator means in accordance with a result of such calculation.

It is to be understood that numerals appearing in parentheses indicate reference numerals applied to parts or elements used in an embodiment to be described later for convenience of reference, but it should be understood that the parts or elements used in practising the invention are not limited to the specific elements or parts illustrated in the embodiment.

The amount of leftover lower thread is equal to an initial length of the lower thread disposed as a winding on the bobbin, from which an expended length of the lower thread is subtracted. However, it will be understood that in a general operation of the sewing machine, the same amount of an upper and a lower thread are used simultaneously to achieve a sewing operation, and hence the expended amount of the upper thread is substantially equal to the expended amount of the lower thread. Accordingly, the described calculation may be performed by utilizing the expended length of the upper thread instead of the expended length of the lower thread, without causing a significant error.

For this reason, in accordance with the first feature of the invention, the amount of rotation of a rotary tension regulator disposed on a path for an upper thread is detected by rotation signal generator means, thus deriving an expended length of the upper thread, or indirectly, an expended length of the lower thread. Means for calculating the leftover amount calculates the leftover amount of the lower thread based on a length of winding on the lower thread bobbin which is supplied from the input means, or by an operator, for example, and the calculated expended length of the upper thread, and produces an alarm, for example, when the leftover amount reduces below a given value.

The rotary tension regulator normally rotates in a given or forward direction as the upper thread is being consumed, but may rotate in a reverse direction as a result of a slack present in the thread, for example. Accordingly, if the amount of rotation of the rotary tension regulator is simply accumulated, the amount of rotation in the reverse direction will be added to the amount of rotation in the forward direction, causing a relatively large error in the calculation of the expended length of the upper thread.

According to the second feature of the invention, the rotation signal generator means delivers a plurality of signals having mutually different phases, and the means for calculating the leftover amount discriminates the direction of rotation of the rotary tension regulator in accordance with a phase difference between the plurality of signals, and determines the expended length of the upper thread based on the amount of rotation in the forward and the reverse direction, thus effectively cancelling the error.

Often, an industrial sewing machine as used in an embroidery machine is constructed to allow a desired needle or thread color to be selected by a needle selector from a plurality of upper thread supply systems in order to change automatically between a plurality of threads of different colors for performing a sewing operation. In such instance, one of the plurality of colored thread is successively selected as the upper thread, and the selected one upper thread alone is expended at any one time while a single lower thread is employed and thus is continuously expended.

Accordingly, the invention incorporating the third feature is utilized in a sewing machine provided with a plurality of rotary tension regulators, through which each of a plurality of upper threads passes. Specifically, the amount of rotation of a rotary tension regulator disposed on a path for each upper thread is detected by associated rotation signal generator means to derive an expended length of the respective upper thread. Then, on the basis of a total of expended lengths of all the upper threads or an expended length of the lower thread and a length of the winding on the lower thread bobbin which is supplied from the input means, as by an operator, the amount of leftover lower thread is calculated. An alarm is produced whenever the leftover amount reduces below a given value, for example.

DETAILED DESCRIPTION OF PREFERRED EMBODIMENT

Figure 1:
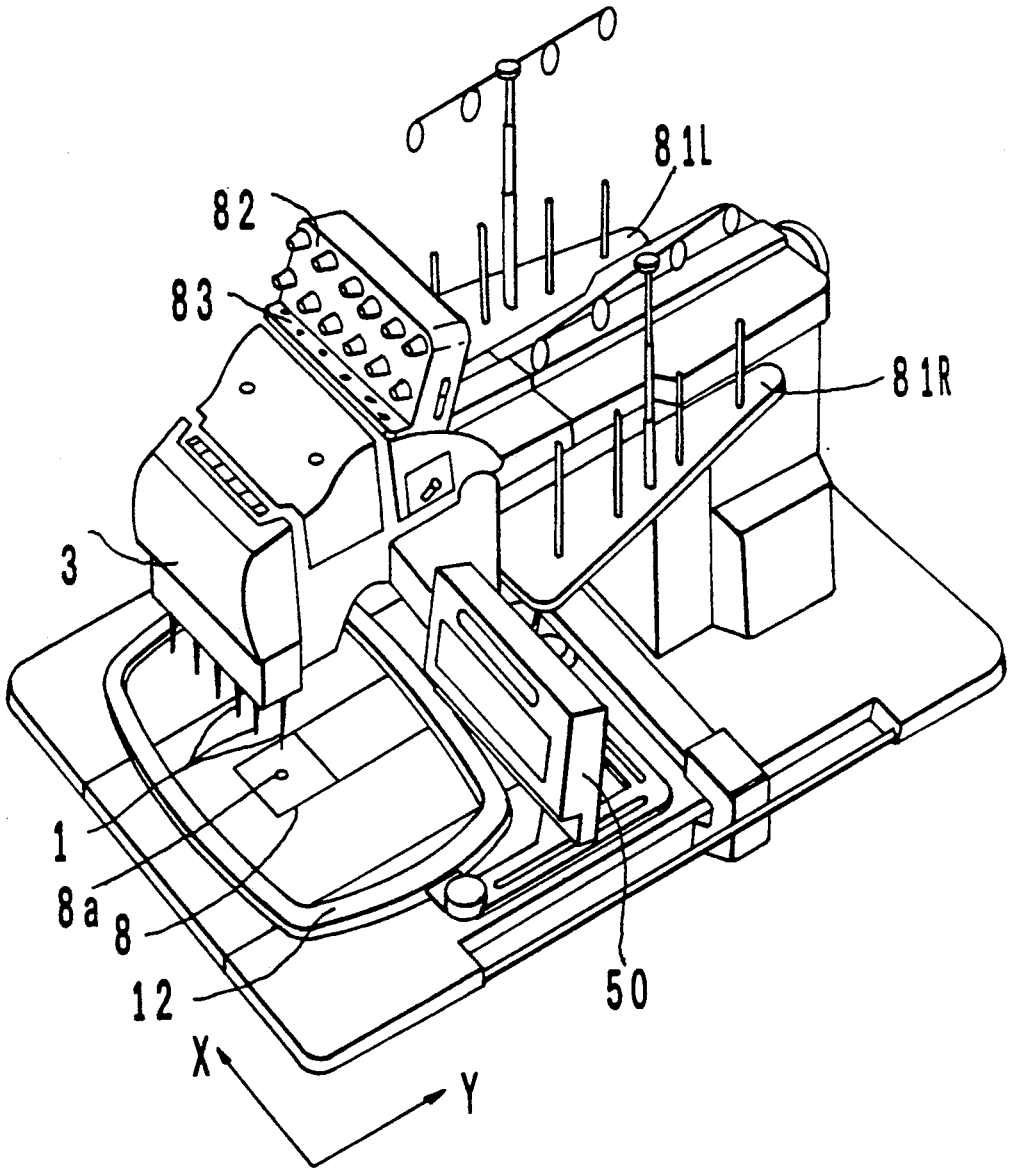
FIG. 1 is a perspective view, showing the appearance of an embroidery machine according to an embodiment.

The appearance of an overall embroidery machine according to an embodiment is shown in FIG. 1. The embroidery machine is provided with six sewing needles 1, one of which is selected by a known needle selector and is positioned directly above a needle hole 8*a* in a throat plate 8 before it is driven up and down for performing a sewing operation. An embroidery frame 12 which is formed so as to surround the needle hole 8*a* is driven in the directions of X- and Y-axes in a horizontal plane when the sewing needle 1 is located above it in order to move a next desired stitch position on a fabric which is supported thereby to the location of the needle hole 8*a*.

A pair of bobbin winders 81L and 81R on which thread bobbins are disposed are mounted on the left and the right side of a machine arm. Four bobbins may be normally mounted on each of the bobbin winders 81L and 81R. Each of threads taken out of six bobbins out of the total of eight bobbins is passed through a thread tension regulator unit 82, through an opening in a guide plate, and through an opening in a thread take-up lever to be engaged with each sewing needle 1.

Figure 2:
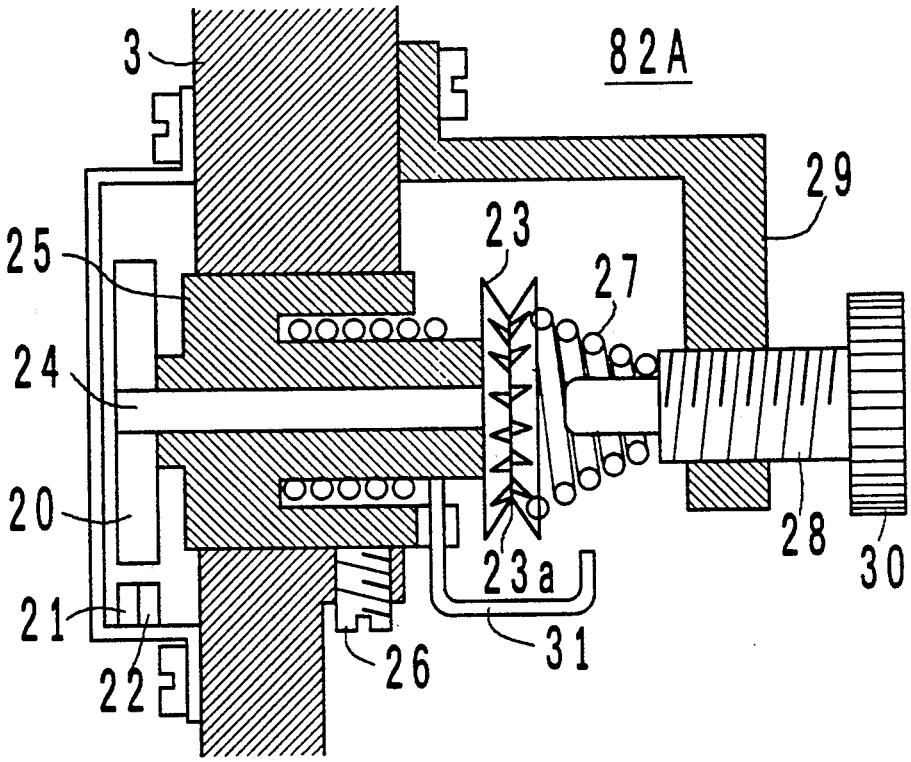
FIG. 2 is a schematic section illustrating a part of the embroidery machine shown in FIG. 1.

The thread tension regulator unit 82 includes six independent rotary tension regulators juxtaposed to each other through which each of threads taken out of the six bobbins is passed. The construction of one of the rotary tension regulators, 82A, is specifically shown in FIG. 2. A rotary tension disc 23 is configured as comprising a pair of dishes coupled together back-to-back in superimposed relationship, thus defining a reduced diameter portion 23*a* at the center as viewed in its thickness direction, around which a single upper thread is passed to extend around half the perimeter thereof so as to be guided thereby. The rotary tension disc 23 is constructed of an elastic metal material so that the diameter of the portion 23*a* varies in accordance with the magnitude of a force applied thereto in the direction of thickness. A tension shaft 24 which is secured to the center of the rotary tension disc 23 is rotatably supported by a bearing 25, which is in turn fixedly mounted in the frame 3 of the embroidery machine by a set screw 26. Accordingly, the rotary tension disc 23 rotates with the tension shaft 24 as the upper thread which is passed thereon moves.

A coiled compression spring 27, which is shaped into a conical configuration, has its one end disposed in abutment against one end face of the rotary tension disc 23, while the other end of the spring 27 is supported by a tension regulating shaft 28, the outer periphery of which is formed with threads meshing with a fixture 29 which is secured to the frame 3. A tension dial 30 is secured to one end of the tension regulating shaft 28. When the tension dial 30 is turned as by an operator, the tension regulating shaft 28 will be axially displaced with respect to the fixture 29, thus changing the position of the other end of the compression spring 27. In this manner, the magnitude of a force applied to the rotary tension disc 23 by the compression spring 27 is varied. Thus, by operating the tension dial 30, the diameter of the portion 23*a* of the rotary tension disc 23 around which the upper thread is engaged can be changed. A guide member 31 for removing a slack in the thread is disposed below the rotary tension disc 23.

Figure 3:
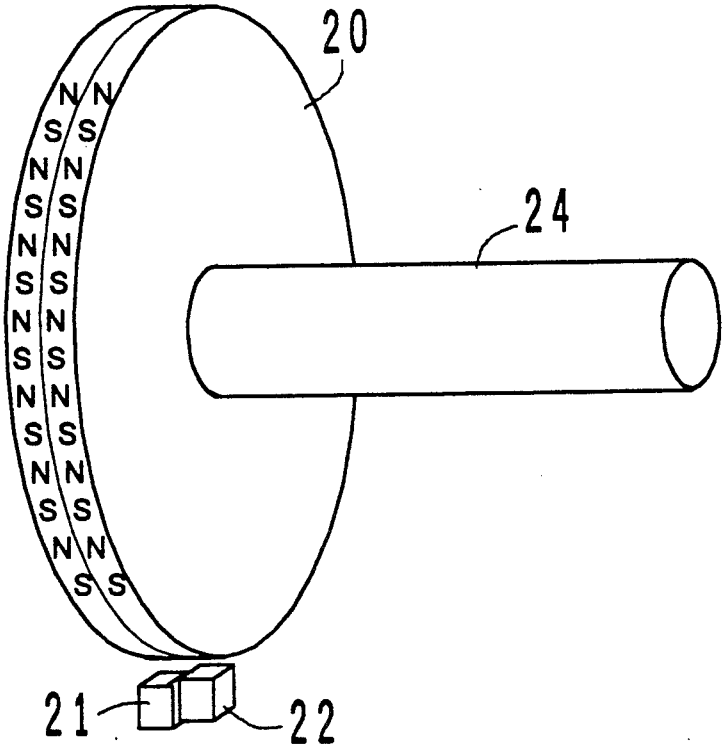
FIG. 3 is a perspective view of a permanent magnet 20 shown in FIG. 2.

A disc-shaped permanent magnet 20 is coupled to one end of the tension shaft 24 by a press fit, and rotates with the tension shaft 24. A pair of Hall elements 21, 22 are located to oppose the permanent magnet 20. As shown in FIG. 3, the peripheral surface of the permanent magnet 20 is magnetized to present N- and S-poles in alternately repeating fashion in the circumferential direction, and these poles are formed in two rows as viewed in the direction of thickness. Additionally, the pair of Hall elements 21, 22 located to oppose the permanent magnet 20 are staggered slightly relative to each other as viewed in the circumferential direction, as indicated in FIG. 3.

Figure 8:
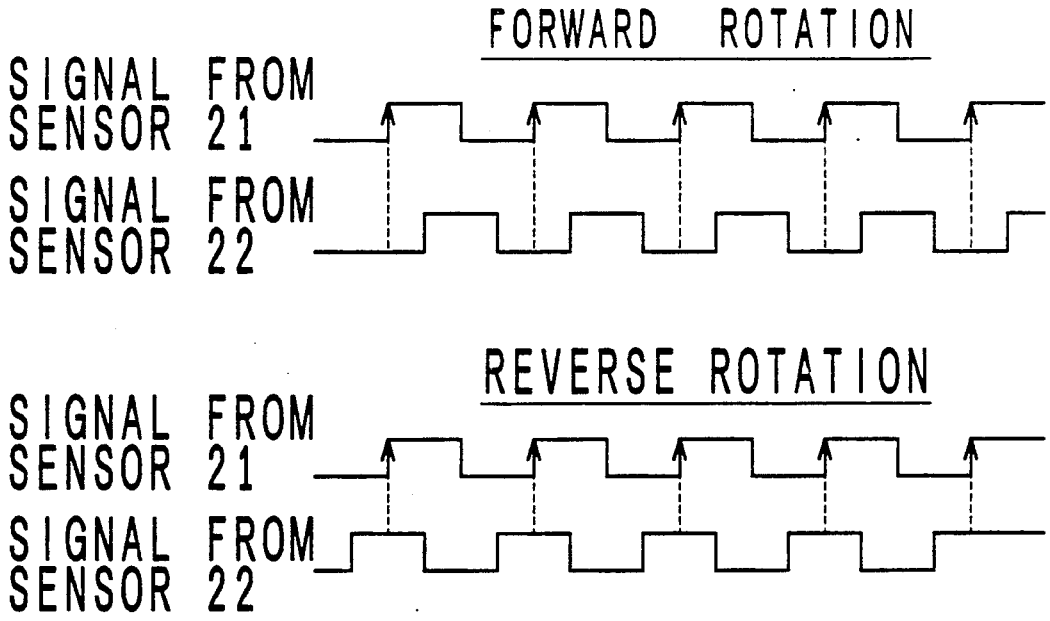
FIG. 8 is a timing chart of signals delivered from Hall elements 21, 22.

Accordingly, as the upper thread which is engaged with the rotary tension disc 23 moves, the latter disc 23 rotates, and when the tension shaft 24 and the permanent magnet 20 rotate, the Hall elements 21, 22 delivers signals in the form of pulses. Since the Hall elements 21, 22 are staggered from each other, there is a phase difference between the signals which are delivered by the respective Hall elements. The positions of these elements are adjusted so that there results a phase difference of 90° in actuality. Referring to FIG. 8, when the permanent magnet 20 rotates in the forward direction, the signal delivered by the Hall element 21 is advanced 90° in phase with respect to the signal delivered from the other Hall element 22. Conversely, when the magnet rotates in the reverse direction, the signal delivered by the Hall element 21 lags 90° in phase with respect to the signal delivered by the Hall element 22. Accordingly, by examining to see the phase relationship of the signals delivered by the pair of Hall elements, namely, either advancing or lagging, it is possible to determine the direction of rotation of the permanent magnet 20.

Figure 4:
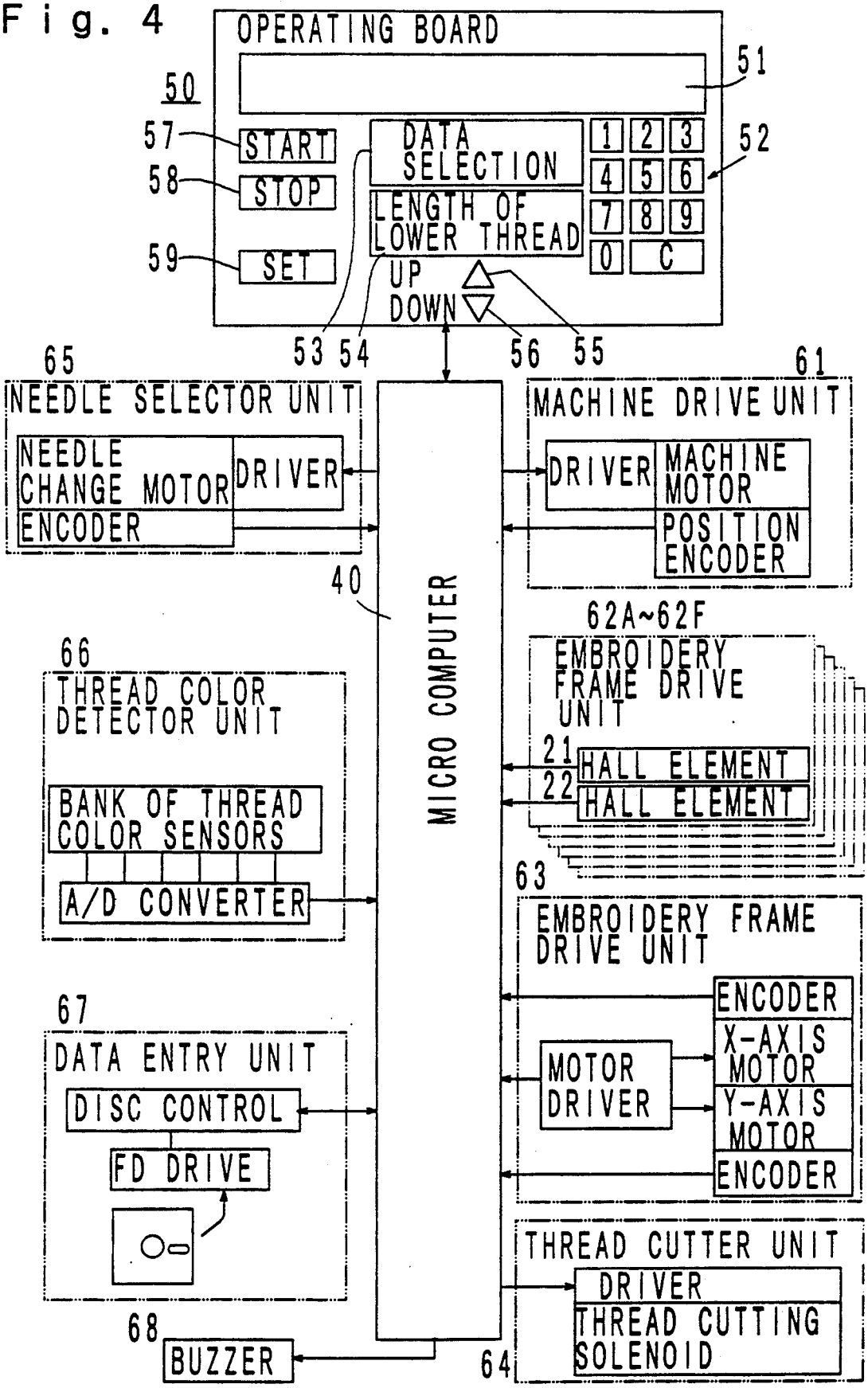
FIG. 4 is a block diagram of an electrical arrangement used in the embroidery machine of FIG. 1.

The embroidery machine shown in FIG. 1 has an electrical arrangement as illustrated in FIG. 4. Referring to FIG. 4, the embodiment shown includes a microcomputer 40 in order to control the entire embroidery machine. An operating board 60, a sewing machine drive unit 61, a leftover lower thread amount detector units 62A to 62F, an embroidery frame drive unit 63, a thread cutter unit 64, a needle selector unit 65, a thread color detector unit 66, data entry unit 67 and a buzzer 68 are connected to the microcomputer 40. The machine drive unit 61, the embroidery frame drive unit 63, the thread cutter unit 64, the needle selector unit 65, the thread color detector unit 66 and data entry unit 67 are similarly constructed as conventional units. There are six units 62A–62F for detecting the amount of leftover lower thread, each including the pair of Hall elements 21, 22 mentioned above to deliver pulse signals in accordance with the rotation of the permanent magnet 20 coupled to the respective rotary tension disc.

The operating board 50 includes a display 51 which is capable of displaying various information items, and various key switches. These key switches include numeral keys 52, data selection key 53, length of lower thread key 54, UP key 55, DOWN key 56, start key 57, stop key 58 and set key 59. The data selection key 53 is used when selecting one item from a plurality of embroidery data stored in a magnetic flexible disc contained in the data entry unit 67. The length of lower thread key 54 is used when entering a parameter which is required in the calculation of the amount of leftover lower thread.

Figure 5:
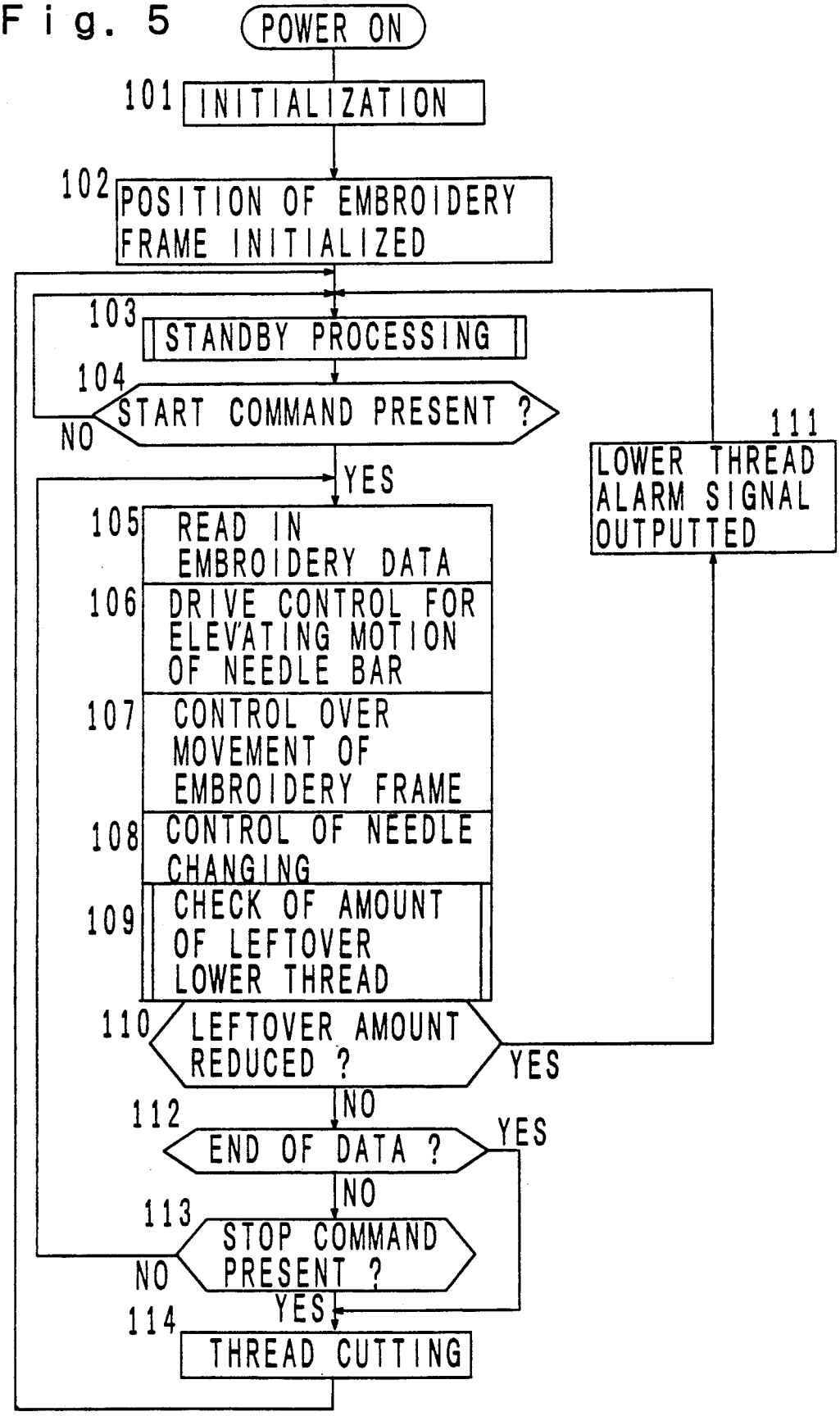
FIG. 5 is a flow chart executed by a microcomputer shown in FIG. 4.
Figure 6:
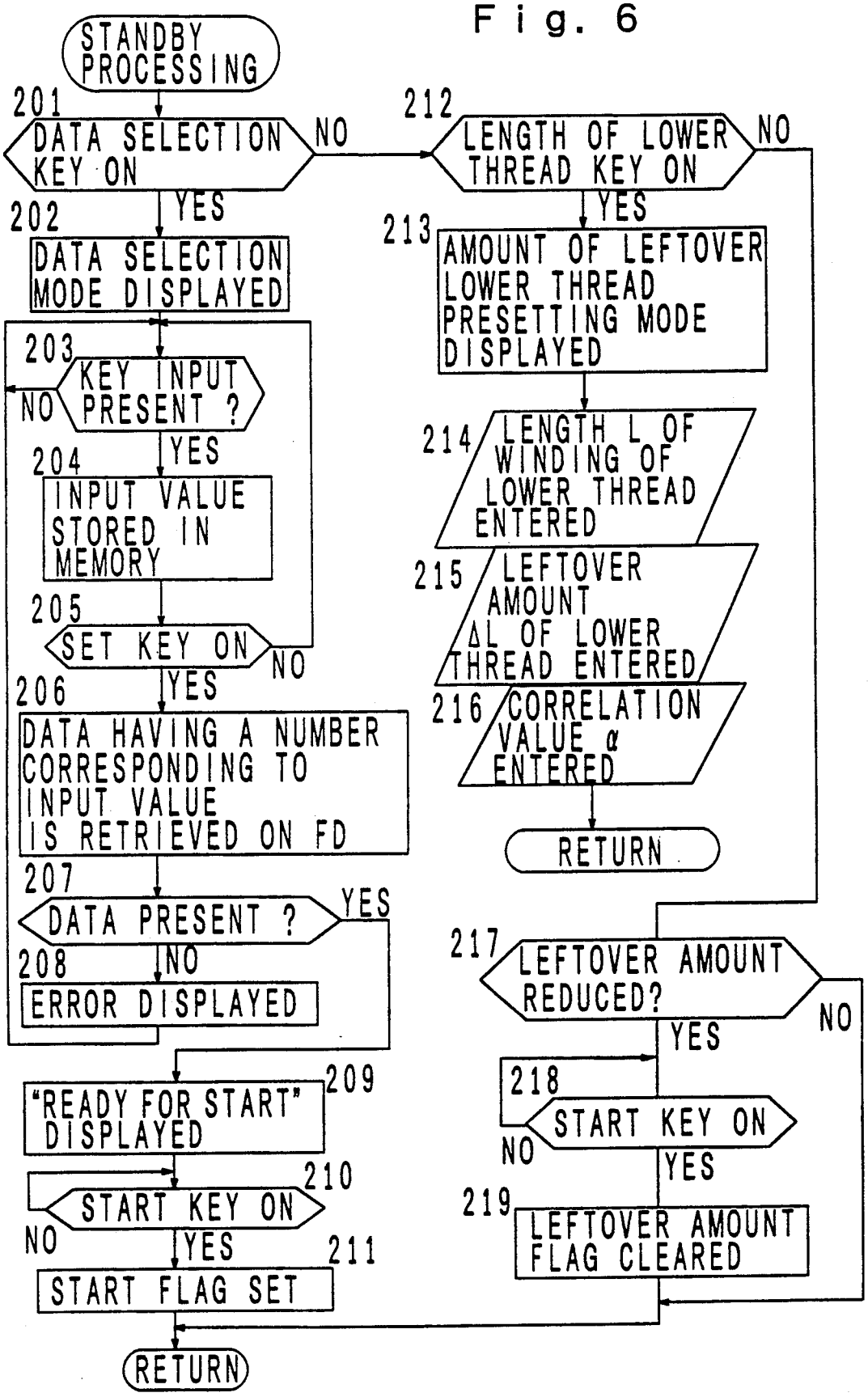
FIG. 6 is a flow chart of a standby processing subroutine shown in FIG. 5.
Figure 7:
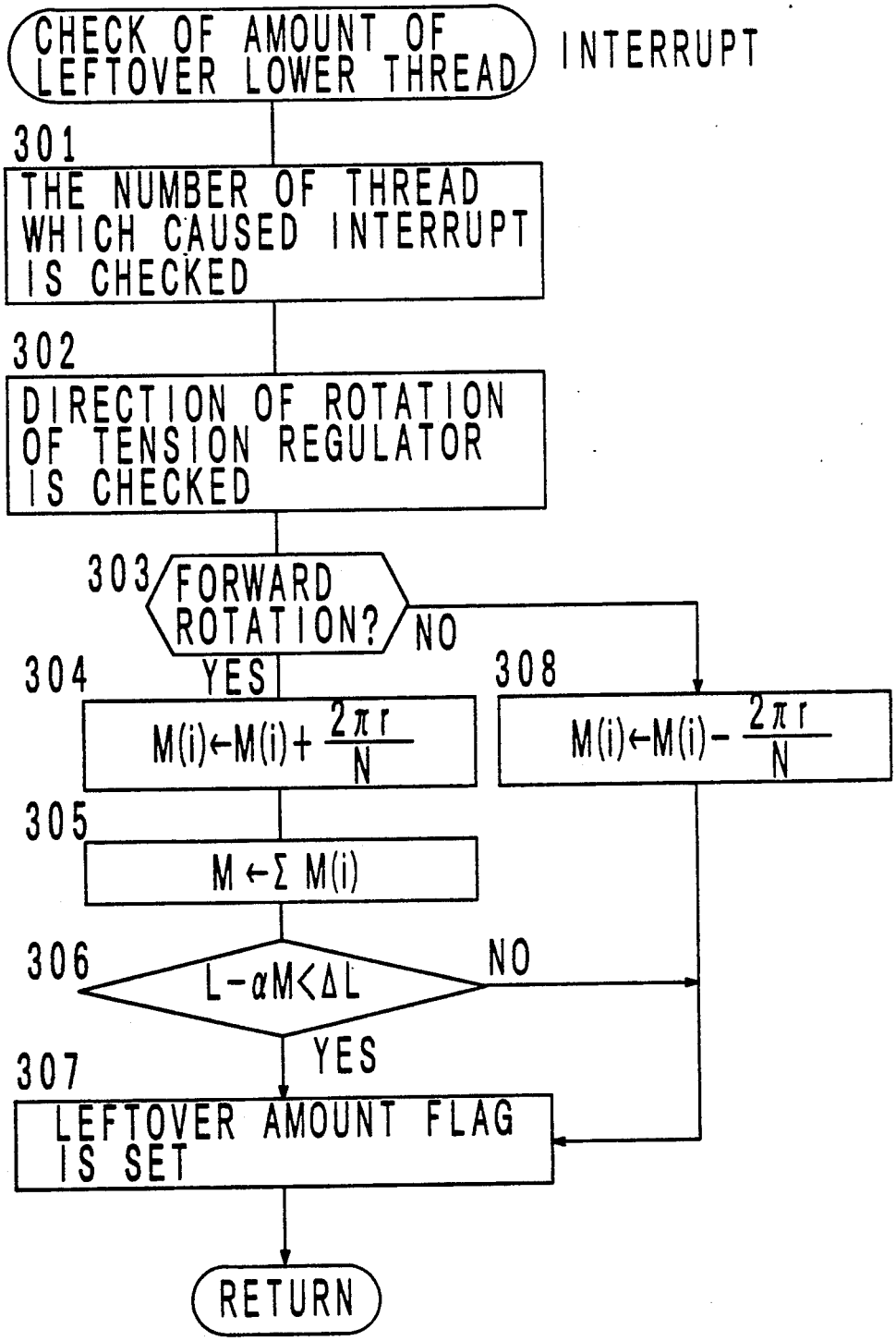
FIG. 7 is a flow chart of a check for the amount of leftover lower thread shown in FIG. 5.

The operation of the microcomputer 40 shown in FIG. 4 is illustrated in FIG. 5, the detail of the standby processing operation (or subroutine shown as step 103) shown in FIG. 5 is illustrated in FIG. 6, and the detail of the check of the amount of leftover lower thread (a subroutine shown as step 109) shown in FIG. 5 is illustrated in FIG. 7. Initially referring to FIG. 5, the entire operation of the embroidery machine will be described. Upon turning on the power supply, an initialization is executed initially. Specifically, internal memories within the microcomputer 40 itself are initialized, various modes are preset, and interrupts are preselected, thus establishing a predetermined initial condition for each unit connected to the microcomputer 40. At next step 102, the embroidery frame is positioned at its initial position.

Then follows a standby processing operation at step 103, which is followed by step 104 where the program loops back until a start command is detected. Upon detecting a start command, the program proceeds to step 105 where selected embroidery data are sequentially entered through the data entry unit 67. At next step 106, the elevating motion of a needle bar 2 is controlled based on the embroidery data; at step 107, the movement of the embroidery frame is controlled; at step 108, a replacement of the sewing needle 1 is controlled; at step 109, "a check of leftover lower thread" is executed; and unless a decision of "amount of leftover lower thread is reduced" is rendered at step 110, the described operation is repeatedly executed until the end of the embroidery data is detected at step 112 or until a stop command is detected at step 113.

When "amount of leftover lower thread is reduced" is decided at step 110, the program then proceeds to step 111 where a lower thread alarm signal is outputted. Thus, the buzzer 68 is energized to give a warning to the operator that the lower thread is being exhausted. In this instance, the steps 105 to 108 are not executed, and the embroidery machine temporarily ceases to operate, but assumes a standby condition. If the end of the embroidery data is detected at step 112 or the stop command is detected at step 113, a thread cutting operation is executed at next step 120, and the program then loops back to the "standby processing" of step 103.

Referring to FIG. 6, the detail of the "standby processing" will be described. When the "data selection" key on the operating board 50 is depressed, the program proceeds from step 201 to step 202, displaying "data selection mode" on the display 51. At step 203, the program waits for a key entry. If one of the numeral keys 52 is depressed, a numerical value corresponding to the operated key is stored in a memory at step 204. When "set" key is depressed at step 205, embroidery data having a number corresponding to the numerical value entered by means of the numerical key is accessed for in the data entry unit 67 and is retrieved. When embroidery data having a number corresponding to the entered value is not found, an error is indicated at step 208 and the program then loops back to step 203. If embroidery data is found, "ready to start" is displayed at step 209, followed by step 210 where the depression of "start" key is waited for. Upon depression of the "start" key, a start flag is set at step 211, and then the program returns to the main routine. The start flag is referred to at step 104 shown in FIG. 5, and if the flag is set, this is interpreted as the presence of a start command.

When "length of lower thread" key on the operating board 50 is depressed, the program proceeds from step 212 to step 213 where predetermined information to be displayed in the "amount of leftover lower thread presetting mode" is displayed on the display 51, followed by successive steps 214, 215 and 216 where the entry of "length L of winding of lower thread", "amount of leftover lower thread $\Delta L$" and "correlation value $\alpha$" is waited for in order to store each entered value into an associated memory. "Length L of winding of lower thread" refers to the length of thread initially wound on the lower thread bobbin, "amount of leftover lower thread $\Delta L$" refers to a length of thread on the lower thread bobbin which corresponds to a threshold where a reduction in the leftover amount is recognized and an alarm is issued, and "correlation value $\alpha$" is a correlation value between "length L of winding of lower thread" and the expended length of the upper thread.

When actually entering "length L of winding of lower thread", "amount of leftover lower thread ΔL" and "correlation value α", entry messages of "length L of winding of lower thread", "amount of leftover lower thread L" and "correlation value" are displayed on the display 51 to wait for the entry. The numeral keys 52 or UP key 55 or DOWN key 56 are then operated to enter desired numerical values. Upon depression of the set key 59, the entered numerical values are stored in a memory, and the program returns. It is to be understood that values which are generally used for "length L of winding of lower thread", "amount of leftover lower thread ΔL" and "correlation value α" are previously stored in respective internal ROM, and unless "amount of leftover lower thread presetting mode" is executed or if the set key is depressed without a preceding entry of numerical values in the "amount of leftover lower thread presetting mode", the content of ROM's is read out to define respective parameters.

In the event the program returns to "standby processing" after the detection of "amount of leftover lower thread is reduced", the program proceeds from step 217 to step 218 and wait for the depression of the start key 57 since the amount of leftover lower thread flag has been set. When the operator changes the used lower thread bobbin with a fresh one and then depresses the start key 57, the program proceeds to step 219 where the amount of leftover lower thread flag is cleared and the program returns to the main routine, thus allowing the operation of the embroidery machine to be resumed.

Referring to FIG. 7, the subroutine "a check of the amount of the leftover lower thread" will now be described. The check actually takes place as an interrupt operation, which is executed in response to an external request for an interrupt produced by the rising edge of a pulse signal delivered from any one of the Hall elements 21 of the six units 62A to 62F for detecting the amount of leftover lower thread detector. At initial step 301, reference is made to the level of individual signals which are output from the six detector units 62A–62F to determine which one of them has made a request for an interrupt. In other words, it is examined at step 301 which one of the upper threads has moved to produce the pulse signal. The number of the upper thread which is determined in this manner is stored as a variable i.

At next step 302, the direction of rotation of the tension regulator is determined. As shown in FIG. 8, at a time corresponding to the rising edge of the signal delivered from one of the Hall elements, 21, the signal delivered from the other Hall element 22 will have an L (low) level for a forward rotation, but assumes an H (high) level for a reverse rotation. Accordingly, at step 302 which is located in time immediately after the occurrence of an interrupt, the level of the signal delivered from the Hall element 22 of the detector unit (namely, one of 62A–62F and corresponding to the variable i) which has produced the signal causing the interrupt is examined in order to determine the direction of rotation of the tension regulator.

When the tension regulator rotates in the forward direction or in a direction to expend the upper thread, the program proceeds from step 303 to step 304. Conversely, if the tension regulator rotates in the reverse direction or in a direction to move back the upper thread, the program proceeds from step 303 to step 308.

At step 304, the expended amount of the upper thread corresponding to the pulse signal which is currently produced, or, $2\pi r/N$ is added to an expenditure of i-th upper thread memory M(i), where r refers to the radius of the portion 23a of the rotary tension disc and N refers to the number of pulses produced per one revolution of the permanent magnet 20. Each content of the expenditure of upper thread memory M(i) is initially cleared to zero, and each time a pulse signal is generated, a corresponding expenditure of upper thread $2\pi r/N$ is added thereto. In order to prevent the occurrence of an error in the detected value of the expenditure of the upper thread as a result of a reversal of the rotary tension disc caused as by a slack in the thread, the expenditure of the upper thread or $2\pi r/N$ is subtracted from the content of the expenditure of upper thread memory M(i) at step 308.

At step 305, a sum of the respective contents of the expenditure memories M(1) to M(6) or the sum of the expenditures of the individual upper threads is obtained and stored in a memory M. At following step 306, an examination is made to see if the amount of leftover lower thread is reduced. Specifically, the expenditure of lower thread is determined as a product of the correlation value α and the total expenditure of upper threads stored in a memory M, and if a difference between the initial length L of winding of lower thread and the expenditure of the lower thread is reduced below a predetermined threshold value ΔL (which may be 1 m, for example), the program proceeds from step 306 to step 307 where the amount of leftover lower thread flag is set. When the flag is set, "the amount of leftover lower thread is reduced" is declared at step 110 shown in FIG. 5, and the embroidery machine generates an alarm, whereby its operation may be stopped.

As the radius r of the portion 23a of the rotary tension disc changes, the expenditure of the upper thread corresponding to one pulse signal or $2\pi r/N$ also varies. Accordingly, where r is fixed, it is necessary to adjust the tension dial 30 to a given position. When it is desired to adjust the tension dial 30, the radius r may be used as a variable and a numerical value which matches a scale on the tension dial 30 may be entered, through the operating board 50, for example, to establish the radius r. If a position encoder is installed on the tension dial 30 or the like, the position of the tension dial 30 may be automatically detected, thereby allowing the radius r to be automatically established. While magnetic detecting means is used in the embodiment to detect the amount of rotation, it may be replaced by an optical or any other detecting means.

As discussed above, in accordance with the invention, the amount of rotation of the rotary tension regulator disposed on the path for the upper thread is detected by rotation signal generator means to allow the expended length of the upper thread or the expended length of the lower thread to be detected indirectly. In response to a length of winding on the lower thread bobbin which may be entered by input means, for example, by an operator, and the calculated expended length of the upper thread, the amount of leftover lower thread is calculated by calculating means, and when the leftover amount reduces below a given value, an alarm is issued. Accordingly, there is no need to apply a special machining to the lower thread bobbin or shuttle race, and the arrangement is insusceptible to malfunctioning even in an environment which is subject to contamination by fragments of thread or oil.

According to the second feature of the invention, the direction of rotation of the rotary tension disc is detected, and the expended length of the upper thread is determined on the basis of amount of rotation in the forward and the reverse direction, so that the expended length of the upper thread can be accurately calculated to determine the amount of leftover lower thread with a high accuracy even if there is a significant slack in the upper thread. According to the third feature of the invention, in a sewing machine provided with a plurality of rotary tension discs through which each of a plurality of upper threads passes, the amount of leftover lower thread can be detected on the basis of the expended length of the upper threads.

What is claimed is:

1. An apparatus for detecting amount of leftover lower thread in a sewing machine, comprising:

input means for entering information indicative of a length of winding on a lower thread bobbin;

a rotary tension disc disposed on a path for an upper thread;

rotation signal generator means for delivering a signal which depends on the amount of rotation of the rotary tension disc disposed on a path for an upper thread, and said rotation signal generator means includes a plurality of signal generator means delivering signals having mutually different phases;

annunciator means for delivering a leftover amount signal at least when the amount of leftover lower thread reduces below a given value; and means for determining the direction of rotation of the rotary tension disc based on a phase difference or differences between the plurality of signals delivered by the rotation signal generator means and determining the expended length of the upper thread based on the amount of rotation in the forward and the reverse direction, for calculating the amount of leftover lower thread based on the length of winding on the lower thread bobbin as supplied from the input means and the expended length of the upper thread, and for energizing the annunciator means in accordance with a result of such calculation.

2. An apparatus for detecting amount of leftover lower thread in a sewing machine,. comprising:

input means for entering information indicative of a length of winding on a lower thread bobbin;

a plurality of rotary tension discs through which a plurality of upper threads pass;

a plurality of rotation signal generator means for delivering signals which depend on the amount of rotation of each rotary tension disc;

annunciator means for delivering a leftover amount signal at least when the amount of leftover lower thread reduces below a given value; and means for calculating the expended length of each upper thread based on the signals delivered by the plurality of rotation signal generator means, for calculating the amount of leftover lower thread based on the total expended length of the upper threads and the length of winding on the lower thread bobbin as supplied from the input means, and for energizing the annunciator means in accordance with a result of such calculation.

* * * * *